United States Patent [19]

Carlson

[11] Patent Number: 4,890,532

[45] Date of Patent: Jan. 2, 1990

[54] FOOT ACTIVATED MUSICAL DRUM PEDAL DEVICE

[75] Inventor: Karl Carlson, Fairbanks, Ak.

[73] Assignee: Garrison & Stratton, Seattle, Wash.

[21] Appl. No.: 148,034

[22] Filed: Jan. 25, 1988

[51] Int. Cl.[4] ..... G10D 13/00

[52] U.S. Cl. ..... 84/422.1

[58] Field of Search ..... 84/422 R, 422 C

[56] References Cited

U.S. PATENT DOCUMENTS 1,319,994 10/1919 Dorn ..... 84/422 R
3,316,792 5/1967 Ippolito ..... 84/422 R
3,797,356 3/1974 Duffy et al. ..... 84/422 R
4,691,613 9/1987 Jacobson ..... 84/422 R

*Primary Examiner*—Lawrence R. Franklin
*Attorney, Agent, or Firm*—Patrick Michael Dwyer

[57] ABSTRACT

An improved foot activated, musical drum pedal device for use in conjuction with a musical drum is provided with a pulley wheel on the toe end of the pedal. A lever member attached to a crossarm activates a mallet with a soft mallet head poised towards the drum. The lever member and pulley are interrelated to magnify the up/-down motion of the toe end of the pedal into the swinging action of the mallet.

2 Claims, 1 Drawing Sheet

FOOT ACTIVATED MUSICAL DRUM PEDAL DEVICE

BACKGROUND

The present invention relates generally to foot activated musical drum impacting devices and more particularly to devices used in conjunction with a musical drum which translates foot motion into motion of a mallet to impact the surface of a drum.

Standard foot activated musical drum pedal devices are known in the prior art to include generally a base, foot pedal and, mallet head mechanically linked together to translate foot motion into a drum beating activity. These devices are generally used in conjunction with a large musical bass drum. The pedal device generally is fixed to a bottom portion of the bass drum rim. The musician generally sits back and above the pedal device. The device is activated by the musician depressing the foot pedal which causes the mallet head to impact a surface of the bass drum.

The speed of the mallet head impacting the drum head defines, in part, the quality of the music produced by the drum. The faster the mallet strikes the drum, the louder and crisper will be the resounding beat.

Generally, the bass drum is used to define the time, tempo or meter in music. The foot pedal is rhythmically depressed by the musician according to the tempo of the music played.

Present devices directly link a lever arm attached to a crossarm supported by a pair of uprights generally above the toe end of a foot pedal. The linkage is usually a flexible member such as nylon cordage. In some prior art models, the flexible member is attached to the rear portion of a curved lever arm with upward pulley grooves. The flexible member is wrapped through the pulley grooves over the forward end of the lever arm, and then downward to attach directly to the toe end of the foot pedal. More expensive models replace the lever arm with a sprocket wheel and employ a chain drive as the flexible member. The chain drive is attached to a rearward portion of the sprocket wheel, arranged over the wheel to be attached directly to the toe end of the foot pedal.

For both devices, the direct coupling of the flexible member to the toe end of the foot pedal fails to provide a satisfactory mechanical advantage whereby the motion of the foot pedal can be amplified to cause the mallet head to strike the drum surface faster.

Accordingly, it is a general object of the present invention to provide an improved foot activated musical drum impacting device by providing a means to magnify the conversion of the foot motion of the drummer, thereby magnifying the speed of the mallet as the mallet strikes the drum.

It is also an object of the present invention to use as much as possible the present components of standard foot activated musical drum pedal devices.

It is also an object of the present invention to modify the toe end of the foot pedal of a standard foot activated musical drum pedal to incorporate a pulley wheel assembly and to mechanically link the standard foot activated device in such a way as to magnify the motion of the foot pedal into mallet head speed.

These and other objects of the present invention will become apparent from the follwing specification and are accomplished by means hereafter described and claimed, the invention being measured by the appended claims and not by the details of the specification.

SUMMARY OF THE INVENTION

The present invention is embodied in a foot activated musical drum pedal device wherein the motion of a foot pedal is translated into a motion of a mallet head striking toward a drum surface. The pedal device includes a base, foot pedal and, mallet head on a handle attached to a lateral pointing crossarm. The crossarm is on roller bearings, supported by a pair of vertical members held upright from a base. A forward rotation of the crossarm rotates the mallet head forward of the base. A toe end of a pedal, pivotally attached to the rear portion of the base is constrained between the vertical members generally below the crossarm.

A lever means , with a forward portion extending generally farther from the crossarm than does a rearward portion, is attached to the crossarm to translate a rotation of the lever means to a rotation of the crossarm. The invention includes a pulley wheel assembly fixed to the toe end of the pedal and generally under the lever means.

In a preferred embodiment, the lever means can be a curved lever with an upper indenture or groove. A multifilament cord such as nylon or similar material is fixed to the rear portion of the lever means, that is a portion of the lever means fixed rearwardly of the crossarm. The cord is laced forward, above and over the lever means, downward to and then around the pulley wheel rearwardly on the toe end of the pedal and upwards to attach to the rear portion of the lever means. The pulley wheel attached to the toe end of the pedal linked in this way to the crossarm provides a mechanical advantage to the device, thereby increasing the distance of travel of the mallet head when compared to the prior art devices which link the lever means directly to the toe end of the pedal.

A downward rotational movement of the pedal rotates the crossarm in a manner faster than if the cord were simply fixed between the lever arm and the toe end of the pedal.

While a preferred embodiment describes a curved lever member, obviously, this invention encompasses equivalent functional elements, such as sprocketed wheels and pulley chains, drums and straps and the like.

PREFERRED EMBODIMENT

Figure 1:
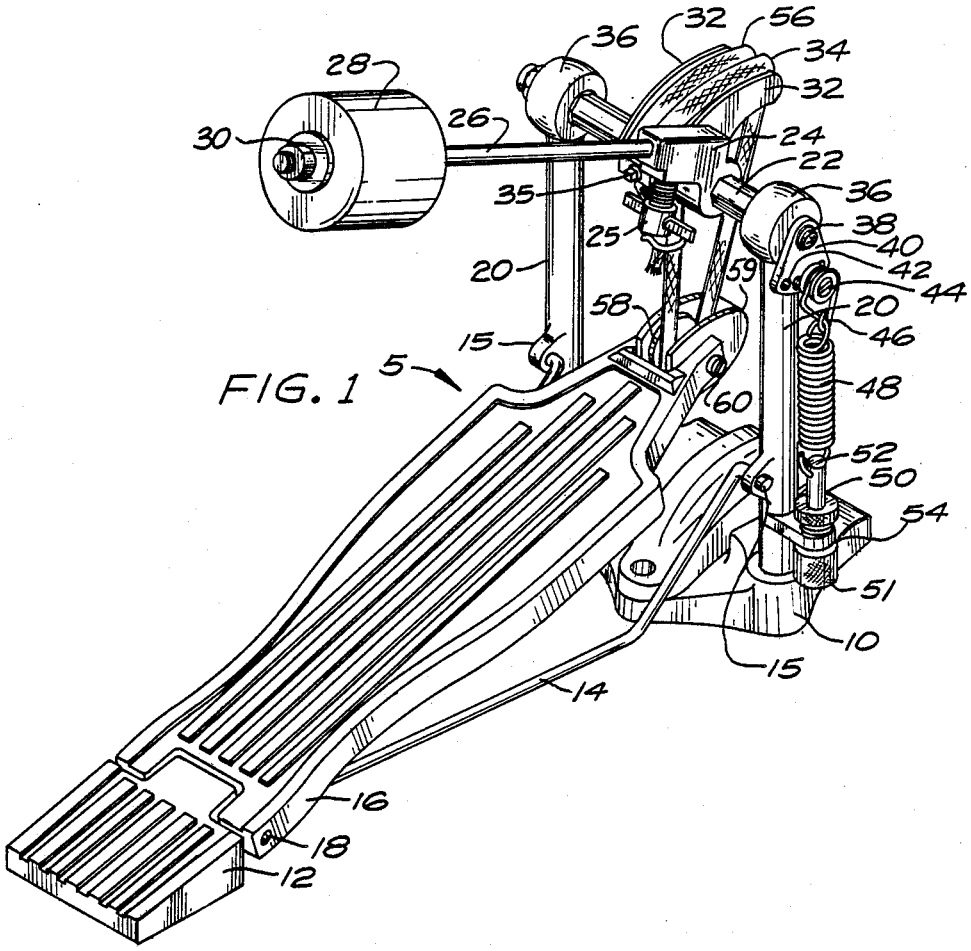
FIG. 1 is a perspective view of a preferred embodiment of an improved foot activated musical drum pedal device.

Referring to the drawing, drum pedal device 5 comprises a forward base 10 and a rearward base 12 interrelated by a connecting member 14. A foot pedal 16 attaches to the rearward base 12 by a hinge pin 18 to permit an up/down rotation of the toe end of the foot pedal 16. Arising from the forward base 10 are two vertical supports or uprights 20. The connecting member 14 attaches to a mid portion 15 of the vertical supports. A hexagonal crossarm 22 spans the uprights 20. A mallet base 24 with a matching hexagonal channel attaches to a midsection of hexagonal crossarm 22, and can be locked thereto with a set screw (not shown). A mallet handle 26 fits into a recess in the mallet base 24 and is locked by thumbscrew 25. A mallet head of soft material 28 is fixed to the end of the mallet handle 26 with a mallet head nut 30. Also attached to the midsection of the hexagonal crossarm 22 is a curved lever means 32 which has upper pulley grooves 34 and is fixed to the hexagonal crossarm 22 by a setscrew 35. The crossarm is attached to the upper parts of the vertical supports 20 with ball bearings 36. With this arrangement a rotational movement of the crossarm 22 swings the mallet head 28. A bias lever 40 is attached to one end of the crossarm 22 with a screw 38. The bias lever has several recesses 42 through which a set pin 44 holding a spring linkage 46 and spring 48 may be attached. The various recesses 42 provide the device with a means to adjust the stationary poise, or rest position of the mallet 28. The other end of the spring 48 attaches through a passage 52 of an adjustably threaded bolt 50 with knurled adjustment head 51. The adjustable threaded bolt 50 attaches through an offset 54 near the base of one of the uprights 20. A flexible member 56 composed of nylon braiding or other equivalent cordage is wrapped from the rearward part of the curved lever means 32 through the pulley grooves 34 to wrap around a pulley wheel 58. The pulley wheel 58 is attached within an assembly 59 to the toe end of the foot pedal 16 using a screw bolt 60. The other end of the flexible member 56 attaches to the rearward portion of the curved lever means 32. With this arrangement a downward movement of the foot pedal 16 produces a rotation of the crossarm 22 and the resulting swinging of the mallet head 28.

In the prior art, the flexible member 56 composed of nylon braiding or other equivalent cordage is wrapped from the rearward part of the curved lever means over the curved lever means through the pulley grooves 34, downward to attach directly to the toe end of foot pedal 16. A downward movement of the toe end of the foot pedal 16 is translated only into a simple forward rotation of the hexagonal crossarm 22, mallet handle and mallet head 28.

The present invention incorporates a pulley wheel 58 attached to the toe of the foot pedal 16 using a screw bolt 60. The flexible member 56 is wrapped from the rearward part of the curved lever means over the curved lever means through the pulley grooves 34, downward, around the pulley wheel 58, and upwards to be attached to the rearward part of the curved lever member. With this arrangement, a downward movement of the toe end of the foot pedal 16 translates into a magnified forward rotation of the hexagonal crossarm 22, mallet handle and mallet head 28. The pulley arrangement at the toe end of the foot pedal 16 offers a mechanical advantage over the prior art so that a downward motion of the toe end of the foot pedal greatly increases the forward rotational motion of the mallet head 28, thereby greatly improving the quality of the resulting sound.

Although the present invention is described and illustrated herein by reference to a preferred embodiment, it should be understood that various substitutions, modifications and alterations that may be apparent to one skilled in the art may be made without departing from the essential spirit of the invention. For example, in another embodiment of the present invention, the curved lever means 32 with pulley grooves 34 and the pulley wheel 58 with assembly 59 are replaced by a curved sprocket lever and sprocket wheel interrelated by a chain drive linkage member to produce the same mechanical advantage. The chain can either be attached to the curved sprocket lever in a manner similar to the described embodiment or the ends of the chain may be attached to form a chain belt.

What is claimed is:

1. In a drum pedal device having in combination a forward base, a pair of uprights at the sides of the forward base, a crossarm rotatively mounted between the uprights, a mallet with a soft head rigidly mounted by a handle to rotate with the crossarm, a bias means to urge the crossarm with mallet in a rearward direction, a rearward base separated from the forward base, a pedal pivotally attached by a heel end to the rearward base assuming generally an upwardly inclined slope to a toe end position generally between the uprights above the forward base and below the crossarm, and a flexible linkage member, the improvement comprising:

a pulley wheel rotatively attached to a toe end of said pedal; and a nonconcentric curved lever means affixed generally to the mid portion of the crossarm, a forward portion of said lever means extending generally upwards and forwards of the crossarm, a rearward portion of the lever means extending generally downward and rearward of the crossarm, said forward portion of said lever means extending generally farther from the crossarm than said rearward portion of said lever means, the upper surface of said lever means indented with a pulley grooved means;

wherein the flexible linkage member interrelates the toe end and the curved lever means by extending the linkage member from the rearward portion of the lever means through the pulley grooved means around the forward portion of the lever means downwardly along a bottom portion of the circumferential pulley groove in the pulley wheel and thence upwardly to the rearward portion of the lever, both ends of the linkage means attached to the rearward portion of the lever means, whereby a downward rotational movement of the pedal is translated into a forward rotational movement of the crossarm with mallet.

2. A drum pedal device comprising: a base having a forward part and a rearward part; a pair of uprights at the sides of said forward part; a crossarm rotatively mounted between the upper potions of the uprights;

a mallet with soft head rigidly mounted by a handle to rotate with the crossarm;

a bias means to urge the crossarm in a rearward direction;

a pedal pivotally attached by a heel end to said rearward part assuming generally an upwardly inclined slope to a toe end position generally between the uprights above said forward part and below the crossarm;

a nonconcentric curved lever means affixed generally to the mid portion of the crossarm, a forward portion of said lever means extending generally upwards and forwards of the crossarm, a rearward portion of the lever means extending generally downwards and rearwards of the crossarm, said forward portion of said lever means extending generally farther from the crossarm than said rearward portion of said lever means, the upper surface of said lever means indented with a pulley grooved means;

a pulley wheel rotatively attached to a toe end of the pedal generally below the lever means, with a circumferential pulley groove in an outer surface of said pulley wheel, said pulley groove aligned with said pulley grooved means; and a flexible linkage member extending from the rearward portion of the lever means, through the pulley grooved means, around the forward portion of the lever means, downward around the pulley wheel, and upwards to the rearward portion of the lever means, both ends of said flexible linkage means attached to the rearward portion of the lever means, whereby a downward rotational movement of the pedal is translated into a forward rotational movement of the crossarm with mallet.

* * * * *